United States Patent [19]

Druss

[11] 4,135,736

[45] Jan. 23, 1979

[54] ADJUSTABLE BOOT-SKI INTERFACE MECHANISMS

[75] Inventor: Barry L. Druss, Holliswood, N.Y.

[73] Assignee: Chimera Research & Development Inc., Holliswood, N.Y.

[21] Appl. No.: 715,698

[22] Filed: Aug. 19, 1976

[51] Int. Cl.[2] ..... A63C 9/00

[52] U.S. Cl. ..... 280/636; 280/633

[58] Field of Search ..... 280/633, 636, 637, 617, 280/618, 610, 613, 614, 615, 607; 248/188.2

[56] References Cited

U.S. PATENT DOCUMENTS

| | | | |
|---|---|---|---|
| 3,306,562 | 2/1967 | Bellefleur | 248/188.2 |
| 3,675,938 | 7/1972 | Sigl | 280/636 |
| 3,772,802 | 11/1973 | Smolka et al. | 280/613 |
| 3,806,144 | 5/1974 | Yans et al. | 280/636 |
| 3,810,643 | 5/1974 | Druss | 280/613 |
| 3,810,645 | 5/1974 | Vouthier | 280/633 |
| 3,865,389 | 2/1975 | Delery | 280/637 |
| 3,902,729 | 9/1975 | Druss | 280/613 |
| 3,944,237 | 3/1976 | Teague, Jr. | 280/637 |
| 4,002,354 | 1/1977 | Ramer | 280/614 |
| 4,007,946 | 2/1977 | Sarver | 280/607 |

FOREIGN PATENT DOCUMENTS

| | | | |
|---|---|---|---|
| 206457 | 11/1939 | Switzerland | 280/636 |
| 212811 | 3/1941 | Switzerland | 280/636 |

*Primary Examiner*—David M. Mitchell
*Attorney, Agent, or Firm*—Tab T. Thein

[57] ABSTRACT

Adjustable boot - ski interface mechanisms for providing elevational adjustment of a skier's boot with respect to the ski and with respect to a separate, extraneous, releasable binding that is fixed to the ski, wherein the binding exerts a predetermined retaining force before releasing the boot from the ski upon occurrence of an external separating force when the skier encounters an obstacle which results in the latter force. The binding includes at least one of a front and a rear rest mechanism, secured to the ski for cooperation with at least one respective interface portion of the boot. The inventive interface mechanism comprises: elements for supporting the boot in a spaced-apart relation with respect to the ski; elements secured to the latter for holding the supporting elements with respect to the ski; elements, at least partly intermediate the holding and the supporting elements, for elevationally adjusting the latter between the boot, on the one hand, and the ski as well as the binding, on the other; and elements for securing the rest mechanism(s) in fixed position to the ski.

2 Claims, 15 Drawing Figures

93
92
95
100
99
98
90
91
94
96
97
102
2
$A^r$
$B^r$
10
8
106
108
105
82
18
6
4
$A^F$
$B^F$
1
107
109
12
14

100
93
99
95
95
98
94
102
14
14
97
$A^r$
$A^r$
$B^r$
$B^r$
96
8
104
108
106
105
104
12
12
1
109
107

2
100
100
102
96
97

115
110
119
110
119
115
110
117
18
116
116
118
16
14
1
1
16
18
14
118
117

ADJUSTABLE BOOT-SKI INTERFACE MECHANISMS

The present invention relates to adjustable boot-ski interface mechanisms, namely arrangements between complementary portions of the interface mechanisms at the heel and the ball of foot or toe areas of the skier's boot, and further wherein interface conditions are adjustably provided relative to the ski binding.

Since the introduction of release-type binding systems interface conditions between the boot and the ski had to be carefully maintained to assure a consistent binding and releasing action.

As in the case of toe-and-heel-type ski bindings, the boot is held to a ski pivot platform wherein contact of the boot to the ski is maintained by vertically adjustable wing- or cup-type toe and/or heel devices that fit over extensions of the sole, front and back of the skier's boot.

In other structures a rest pad or pivot platform is shimmed up to contact with the sole of the boot to provide a solid platform for variations in the interface dimensions for the different boot and profile combinations that are possible. This preliminary procedure is awkward and time consuming for ski shops and requires the latter to carry large stocks of extra different-sized shims for fitting pivot platforms to skis.

Therefore a much simpler method has been sought for some time to adjustably fill the difference in elevation between boots and skis, already having the bindings fixed thereon, to allow satisfactory interface relationships. Contacts at the heel and the ball of foot areas also serve as couples in their relationship with the binding force to retain the boots to the skis. They are also important as friction-reduced areas during the various torque release modes of activity. At the ball of the foot it is common to use what is generally called an "anti-friction pad" between the boot and the ski for this purpose.

It is also understood that this couple relationship can be altered during use to effect different release force requirements for pivotal release, which can be useful in accurately matching different skiers' release needs and preferences during skiing.

A change in the height of the contact area of interface relative to the fixed binding level will change the pivotal release escape angle, which thereby can alter the ratio of release between pivotal and torque release modes.

A feature mentioned in U.S. Pat. No. 3,727,932 of the same inventor, issued Apr. 17, 1973 for "Ski Binding", relates to pivots that are slidably positioned at different locations longitudinally from the binding in order to change pivotal release force requirements. It has been perceived that a superior effect can be acquired by changing the pivots vertically with respect to the binding force, namely to provide elevational adjustment according to the present invention.

The present invention basically relates to a mechanism permitting elevational adjustment of the interface platform between the boot and the ski, having the ski binding thereon, at forward and rearward weight-transfer locations.

Adjustment, preferably of the front rest mechanism, can be accomplished by a member or element inclined with respect to another member or element; or the first member being adjustably supported by the other member; or by being elevated by inclines with respect to two facing second members.

In addition, the invention provides elevational positioning of at least one member at the rear rest mechanism e.g. by threaded means, or by complementary teeth directed normal to the elevational axis. Further there is a proposed structure whereby the heel of the boot is adjustably maintained for cooperation with a like adjustable heel platform on the ski.

There is furthermore an embodiment to retain a connecting member in the interface platform, with its other end being preferably secured to a boot plate, particularly when both front and rear rest mechanisms are provided.

The present invention thus relates to interface mechanisms for elevationally adjusting the interface conditions between the boot and the ski for front and rear pivot conditions, mainly for the purpose of (a) maintaining a solid contact for those conditions when presented with various boot and ski profile dimensions, and (b) changing the pivotal releasing force requirements when matching different skiers' needs for pivot and torque ratio modes of release, e.g. when fitting a new binding to a ski (and/or the skier's boot to a ski having the binding already fixed thereto).

The inventive adjustable interface at the toe area, consituting a front rest mechanism, essentially comprises a base to which a bearing support member is slidably fastened along an incline, common to either member, and further whereby a heel rest (bearing support) fastened to the ski is provided with at least one bearing-support member which makes the elevational adjustment contact to the boot heel by screws held to either the base or the bearing support member(s).

There is also provided a mechanism to adjust the height of the boot heel, namely by a rear rest mechanism of the invention, where the heel portion is retained to slide vertically, using in an exemplary embodiment a dovetail engagement between the boot and its heel. Between these last-named parts there is fastened a threadable adjustment bracket to position the heel at those desirable fixed locations, up or down, as are needed to maintain a secure heel couple during skiing.

In addition, the invention provides a boot plate to be connected to the adjustable bearing support members at the toe and heel ends, e.g. by means of connecting members that can be in the form of retaining straps.

Other objects, important features and advantages of the invention will become clearly understood from the following description when considered in conjunction with the accompanying drawings. Before describing the latter it should however be added that it has been found reasonable, and mostly time saving, not to repeat structural and operational features for the "rear rest mechanism" that have already been described for the "front rest mechanism" (and of course also conversely). All described features are compatible and interchangeable; one "front" feature can be used together with another "rear" feature, or two "front" structures can be used together at the respective toe and heel portions of the skier's boot, and so on. These combined practical embodiments have not been described and shown in more detail to avoid duplicatons and an unnecessary lengthening of the application.

Figure 12:
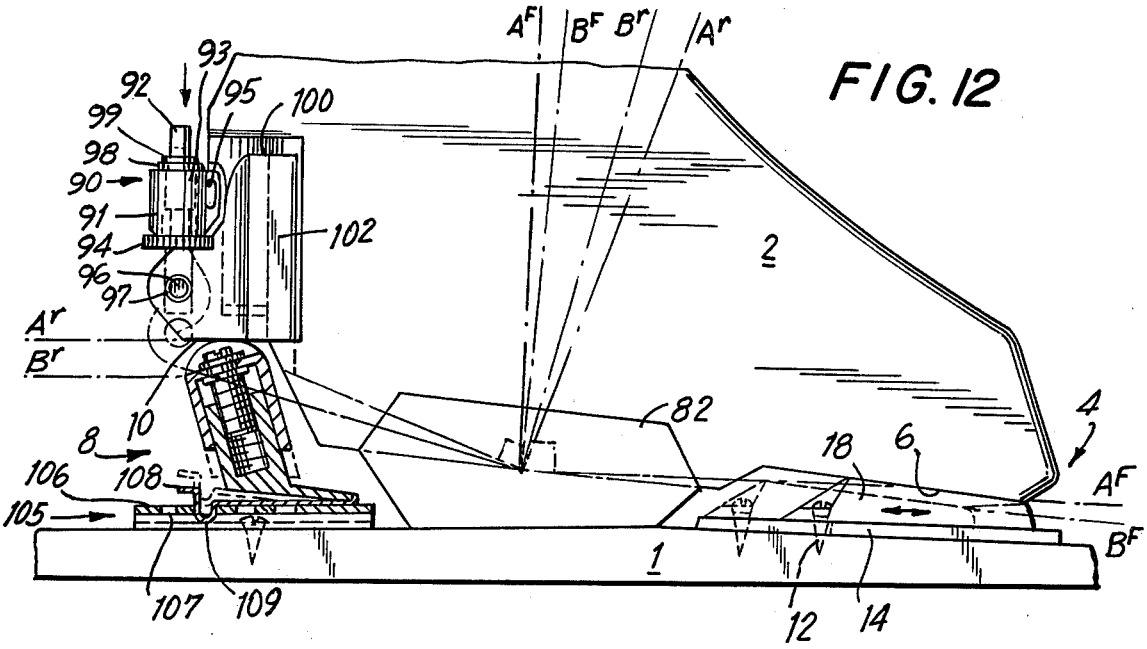
Figure 13:
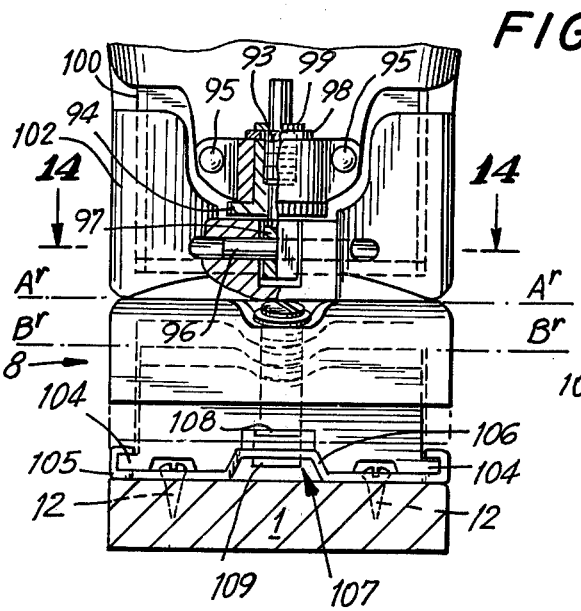
Figure 14:
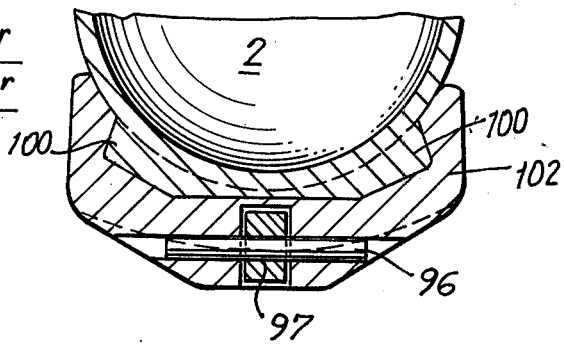
Figure 15:
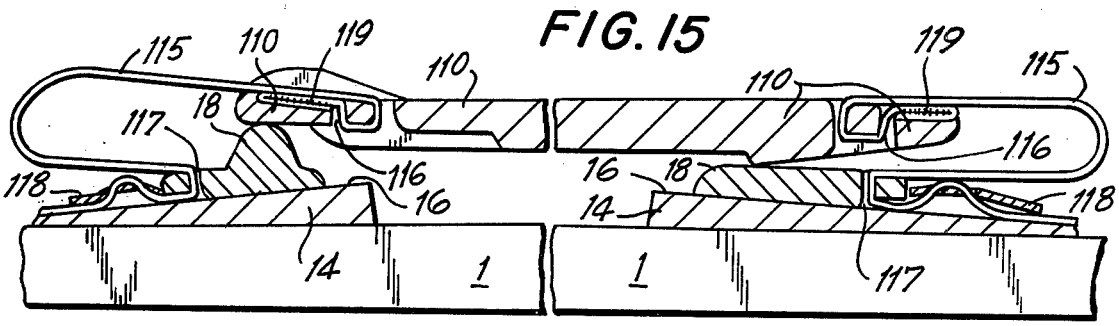

FIG. 12 an assembled side view of an adjustable boot binding ski assembly having elevational interface adjustments;

FIG. 13 is a rear view taken from the end of FIG. 12, showing the adjustable heel or rear assembly partially cross-sectioned on the left side;

FIG. 14 is a cross-sectional view taken along the line 14—14 of FIG. 13, in a substantially horizontal plane; and FIG. 15 is a simplified side view of a plate member having adjustable interface members both at the heel and at the toe portions, with connecting portions attached.

Figure 1:
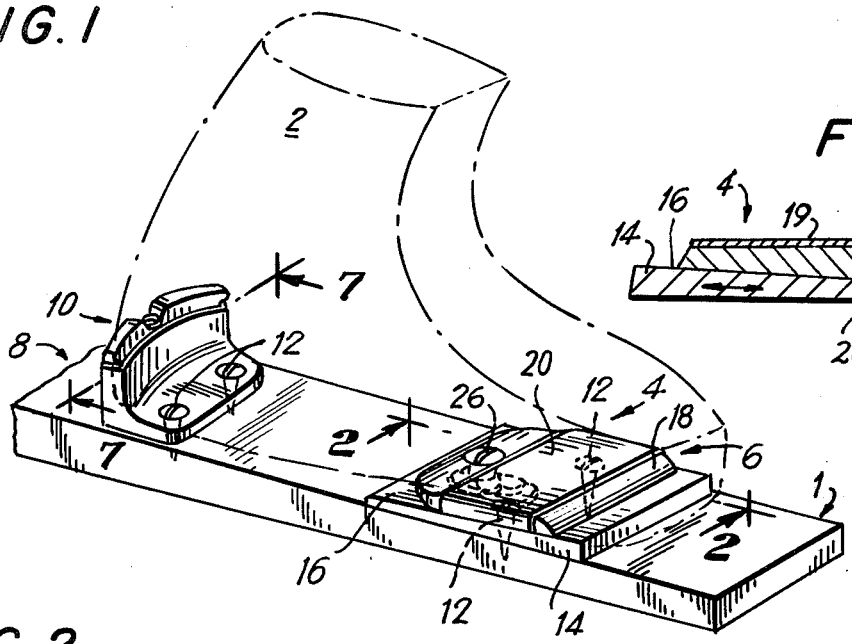
FIG. 1 is a perspective view assembled of a boot and a ski, showing in detail embodiments of the adjustable rests or boot - ski interface mechanisms both at the heel and the ball-of-foot or toe area, according to the invention.

Referring to FIG. 1 there is shown a ski 1 and a boot 2, the latter in imaginary lines, in an assembled relationship, which includes therebetween a front rest mechanism 4 and a rear rest mechanism 8, each having boot sole counterparts, namely a front boot interface 6 and a rear boot interface 10, which bear against the rests 4, 8 during forward or rearward pivotal movement applied by the skier when skiing. A couple is formed between the rest, either forward or rearward, and the binding mechanism (not shown in FIG. 1 but illustrated in FIG. 12) during pivotal moment activity, and when an excessive force causes the binding mechanism to release its hold, the boot interface, either the front 6 or the rear 10 interface, will pivot on the rest 4, 8, creating a fulcrum at the location of the bearing effort between the rest and the boot interface for the ski and the boot, respectively. Numeral 12 will be described somewhat later.

Figure 2:
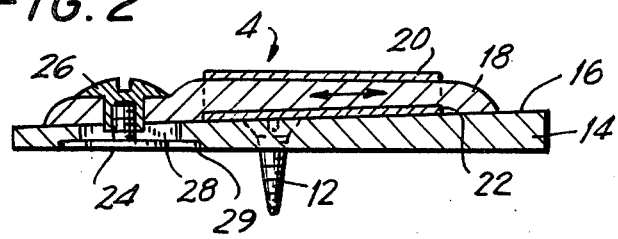
FIG. 2 is a horizontal section through the front rest as shown in FIG. 1, taken along the line 2—2 thereof.

Referring to FIGS. 1 and 2, there is shown the front rest 4 having a base portion 14 which rests on the ski 1 (the base portion is one of the possible embodiments of holding means that form part of the inventive mechanisms). The base portion has an inclined top surface 16 (which is one of the possible embodiments of "adjusting means" that also form part of the inventive mechanisms) to which top a bearing plate 18 is fastened (the plate constituting one of various possible supporting means) by a T-nut 24 and a T-screw 26 (these both constitute possible variants of controlling means that also forms part of the inventive mechanisms), which parts in turn are seated in a slot 28 and a flange slot 29. To adjust the height of the bearing plate 18, the T-screw and nut are loosened, allowing passage in the slot 28 to the desired longitudinal position. In addition the bearing plate 18 holds a band 20 having a relatively low coefficient of friction, adhesively taped to the top surface, with the two ends turned under and into a receptive space 22 of the plate 18, as is commonly used. This band 20 can be replaced when worn due to the constant sliding action of the boot 2 or a boot plate 110 (to be described later) against the surface.

Figure 3:
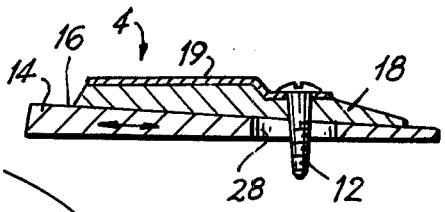
FIG. 3 is a modified embodiment of a front rest, similar to that of FIG. 2.

The preferred embodiment of FIG. 3 is similar in function to the embodiments of FIGS. 1 and 2 except that the base portion 14 is slidably positioned longitudinally relative to the bearing plate 18, which latter is fastened to the ski by attachment screws 12 (these are controlling means in the various embodiments of the inventive mechanisms), one of them being seated in the plate 18 through the slot 28 in the base portion 14 and into the ski 1. The position of the inclined portion 16 on the base portion 14 is determined by the relative location of the slot 28 on the base portion 14 and the length of the slot 28 for movement longitudinally of the base portion 14 with regard to the screws 12. Each screw has a respective slot.

In addition, a hard top plate 19 is positioned on top of the bearing plate 18 for the low frictional properties required. It is understood that such surfaces, made for example of polytetrafluoroethylene or silicon, can be incorporated in the bearing plate itself, as is known practice for existing bearing plates. It nevertheless is in the purview of the invention to provide such a solution inasmuch as the frictional characteristics are a property of two surfaces acting on one another.

The front boot interface 6 can instead be supplied with the required friction-reduced condition (also in the case of the boot plate 110 of FIG. 15). The top plate 19 can better conform to the flexing requirements of the ski 1 in the form of a stainless steel sheet 1/32 inch or less, when used with correspondingly flexible plastic base and bearing plate members 14, 18.

Figure 4:
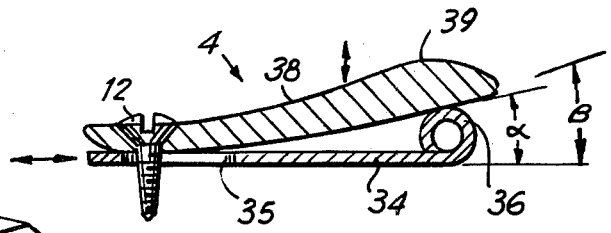
FIG. 4 is a yet further modified embodiment, similar to FIG. 2.

FIG. 4 shows a modification of FIG. 2 wherein the front rest 4 has a slidable base portion 34 with a support portion 36 at one end, and at the other end a slot 35, whereby a bearing plate 38 spans the two ends of the base 34. The bearing plate 38 includes a contact surface 39 against which the boot interface 6 or 10 bears. It can be seen in FIG. 4 how a smaller angle $\alpha$ between the bottom surface of the base portion 34 and the bottom surface of the bearing plate 38 can be increased to any larger value, e.g. as shown at $\beta$, for elevational adjustment, by lengthwise movement of the base portion 34 with respect to the screw 12 having freedom of movement within the slot 35.

Figure 5:
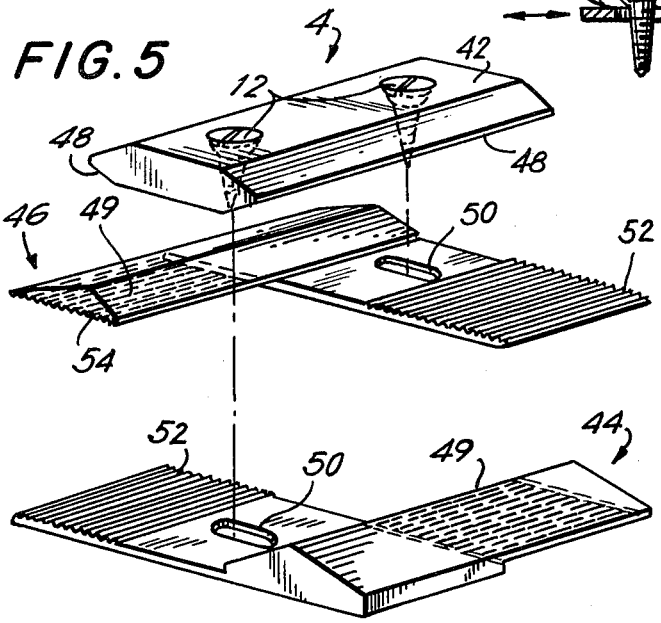
FIG. 5 is an exploded view of yet a further variation of FIG. 2, showing all constituent parts before assembly.
Figure 6:
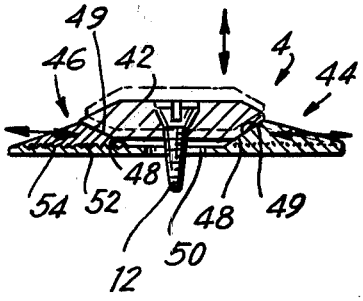
FIG. 6 is a cross-sectional view of the rest of FIG. 5, assembled.

FIGS. 5 and 6 represent a further variation of FIGS. 2 and 3 wherein there is provided an elevation of a transversely oriented bearing plate 42 by cooperation with two base inclined portions 49, for and aft of the plate 42, which in turn has two bearing inclined portions 48. The base members, identical in shape but opposed in position, are a right-hand base portion 44 and a left-hand base portion 46. Each base member has an extended half side which includes a centrally located through slot 50 for screw passage clearance, and a set of upward facing teeth 52 that cooperate with a set of like opposing downward facing teeth 54 (these are again variants of the securing means) located on the opposite base member.

The two base portions 44, 46 can be positioned closer apart to raise, or further apart to lower the height of the bearing plate 42 by the repositioning of the teeth portions 52, 54 in the longitudinal plane on opposing sides of the base portions 44, 46. It should be noted that finer cooperating upward and downward teeth portions 52, 54 allow for smaller elevational differences between successive tooth portions.

Figure 7:
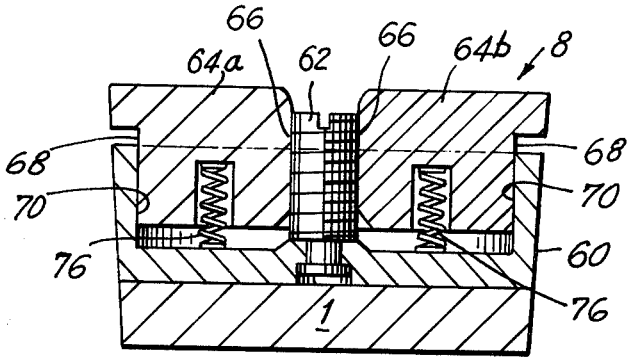
FIG. 7 is a substantially vertical cross-section through the rear rest as shown in FIG. 1, taken along the line 7—7 thereof.
Figure 8:
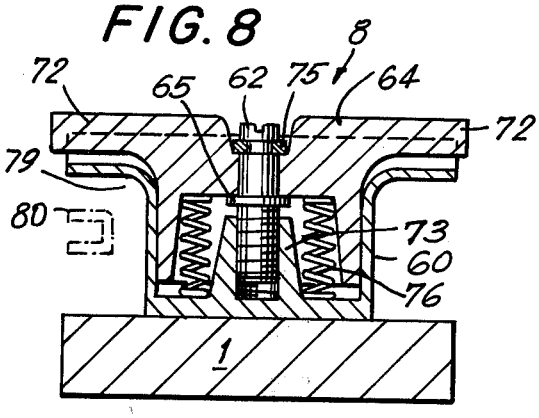
FIG. 8 is a modified embodiment of a rear rest, similar to that of FIG. 7.
Figure 9:
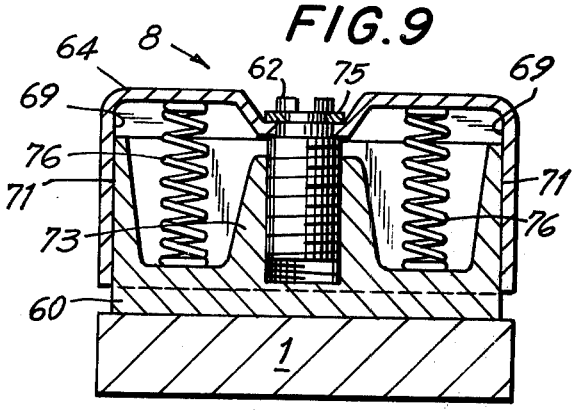
FIG. 9 is a yet further modified embodiment, similar to FIG. 7.

FIGS. 7 to 9 constitute further preferred, exemplary embodiments of the invention. FIG. 7 is a cross-sectional view of the rear rest 8 taken along line 7—7 in FIG. 1. The rest 8 is comprised of a base housing 60 (a specific holding means), a height adjusting screw 62 as well as left-hand and right-hand bearing block members *64a*, *64b*, each of which has inwardly facing profiles that have threaded portions in the form of bearing threads 66, which latter threadably cooperate with the screw 62, and outer sides or bearing slide surfaces 68 which are slidably movable against cooperating inner sides or base slide surfaces 70 of cavity portions of the base housing 60. Numeral 65 will be mentioned somewhat later.

Both FIGS. 8 and 9 are variations of FIG. 7. In FIG. 8, the adjusting screw 62 is rotatably and centrally fastened by a retaining ring 75 to a bearing block member 64, which in turn is also slidably positioned (see the previously described parts 68, 70 although not shown in FIG. 8), namely in the cavity of the base member 60, and further whereby the screw 62 threads into an upraised central portion of the base housing 60 or into a threaded adjustable screw base portion 73. As a matter of example, the illustrations show a pair of biasing springs 76 in FIGS. 7 to 9, maintaining among themselves even pressure against screw 62 in base housing 60 (e.g. left to right, as shown).

In addition, the top sides of the base and the elements 60, 64 have flange portions 72 while the lower sides are made narrower than the ski, thereby defining a space or a side clearance 79 on each side of the ski for the location of a binding latch 80 (shown in imaginary lines), as mentioned in the previous own U.S. Pat. Nos. 3,810,643 and 3,902,729, issued May 14, 1974, and Sept. 2, 1975, respectively, both titled "Ski Binding". The latch 80 is positioned substantially within the side profile of the ski so as not to interfere with edging requirements of the ski against the snow. A screw flange 65 is provided for the screw 62 being held in the bearing member 64.

In FIG. 9, the rear rest 8 includes the bearing member 64 which is hollow for slidably fitting over the base housing 60, and further whereby the height adjusting screw 62 is fastened as in FIG. 8 to the screw base portion 73 of the base housing 60. The member 64 has an inner bearing slide surface 69 against a similar outer base slide surface 71 of the base housing 60. It should be understood that the bearing-block member parts *64a*, *64b* of FIG. 7 perform in a manner similar to the single member 64 of FIGS. 8, 9 and those to be described hereafter.

Figure 10:
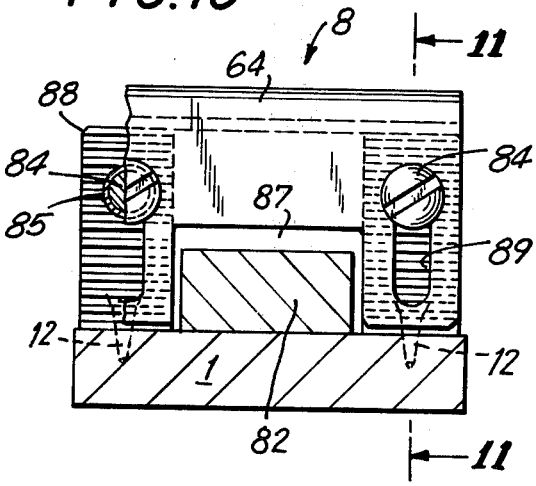
FIG. 10 is yet a further variation of FIG. 7.
Figure 11:
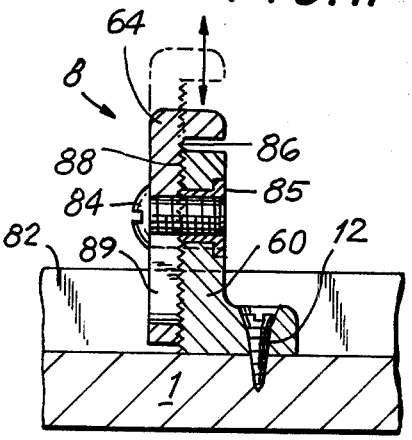
FIG. 11 is a vertical cross-section through the rear rest of FIG. 10, taken along the line 11—11 thereof.

FIGS. 10 and 11 show the rear rest 8 which has the base housing 60 fastened to the ski by the screws 12 or other suitable means; and fastened to the housing 60 on the rear facing side, right and left, by cooperating teeth surfaces or vertical base teeth 86 is the bearing member 64 with likewise matching surfaces or vertical bearing teeth 88, in opposed facing contact. It should again be understood that the smaller the teeth the finer the adjustment permitted elevationally (see FIG. 11). Two screws, namely horizontal adjusting screws 84 on both sides hold the bearing member 64 to the base housing 60 by threaded engagement with horizontal adjusting nuts 85 (screws 84 and nuts 85 are another form of the immobilizing means) fixed into the base housing 60; and two height adjusting slots 89 for screw clearance permit vertical adjustment of the member 64. There is an opening in the middle of the rear rest 8, constituting a central clearance 87, which bridges a portion of a binding 82 that passes through, as is common in many bindings, which have attachment features located below the skier's arch area. Sufficient space is provided along the sides and above the binding (FIG. 10) so as not to interfere with ski deflection.

It will be understood from the description that the holding means also covers and includes base portions 34, 44, 46 in some embodiments; the supporting means is also constituted by top plate 19, band 20, space 22, bearing plates 38, 42, bearing blocks 64, -a, -b and flange portions 72 in the various embodiments; the "adjusting means" further includes slots 28, 29, 35, support portion 36, elements 48 to 50 of FIGS. 5, 6, screw 62 and threads 66 in FIG. 7, elements 65, 73, 75 and 76 in FIGS. 8, 9, and finally elements 86, 88 and 89 in FIGS. 10, 11, in addition to those identified earlier; the securing means is also constituted, in some embodiments, by surfaces 68 to 71 and elements 84, 85 of FIGS. 10, 11.

FIGS. 12 to 14 show the elevationally adjustable interface with respect to the central arch area binding (mechanism) 82. The interface levels shown as $A^r$—$A^r$ and $A^F$—$A^F$ feature a greater escape angle of release for the boot relative to the longitudinal planar axis of the ski, as compared to the lower interface levels shown as $B^r$—$B^r$ and $B^F$—$B^F$. As a general rule the higher the pivotable interace at the heel and the ball-of-the-foot/toe relative to the binding arresting areas, the greater is the impetus to release for those forward or rearward pivotal conditions. The tangential component of the couple between the rest member and the binding changes when the interface is adjusted up or down relative to the ski's running surface, which in turn changes the effect upon the binding force.

Thus pivotal force requirements can be made to fit the needs of different types and kinds of skiers without making any changes in the binding force for those skiers (i.e. the torque force can remain the same while changes can be made for pivotal forces for multi-angularly releasing binding mechanisms).

It is possible in the purview of this invention to actually prevent release when the tangential component of the couple betwen the rest member and the binding, or the pivotal moment, is acutely oriented. This could be useful in preventing rearward release movement activity for certain agressive skiers. An extreme elevation of the rear rest and the boot interface achieves this effect.

FIG. 12 shows a side view of the boot binding - ski relationship with the rear rest 8 drawn in cross-section. It should be understood that the rest 8 may include the elements 69, 71 although not shown here (e.g. in FIG. 9). The binding 82, positioned in the center, below the arch area of the boot, can be any mechanism such as that of the own previous binding patents, as mentioned before, U.S. Pat. Nos. 3,727,932, 3,810,643, 3,902,729 or of other patents or structures. The front rest 4, with its earlier described elements 12, 16, 28 (although the two latter are not shown here again) is similar to that in FIGS. 1 to 3 except that the bearing-plate top surface is inclined downward, toward the front of the ski, so that it can support a higher forward boot interface when the bearing plate is positioned further forward on the ski, or conversely, rearward on the ski, for supporting a lower forward boot interface (shown in imaginary lines).

The boot contains an adjustable rear boot interface which cooperates with different levels of elevational adjustment possible by the rear rest 8. The adjustable interface consists of the rearmost portion of the boot wherein a dovetail 100 contains an adjustable heel 102 for elevational positioning, and whereby a boot heel adjusting mechanism 90 is fastened to the boot, above the adjustable heel (FIG. 13), e.g. by rivets 95 or other suitable means of attachment at one end, and further whereby at its other end it is attached to the adjustable heel 102 so as to fix the latter in any location along dovetail 100.

The extent of elevational travel of the adjustable interface is limited by the lengths of the dovetail 100 and of the adjustable heel 102, restrained along the dovetail.

A partial cross-section of the boot - heel adjusting mechanism 90 is illustrated in FIG. 13, taken along line 13—13 from FIG. 12. It shows an adjustment rod 92 positioned through a heel adjustment housing 91 with a threaded section 93 screwed through a heel adjusting collar 94, which in turn is rotatably secured through a hole in the housing 91 by being formed over a washer 98, creating a retaining flange portion 99.

The top of the adjustment rod 92 is extended above the housing 91, preventing contamination of the threads and at the same time serving to indicate the relative position of the rear boot interface with regard to the boot, e.g. with the use of common indicating or marker lines (not illustrated), spaced regularly along the adjustment rod 92. At the bottom, the rod is secured to the center of the adjustable heel 102 by means of a pin member 96 which passes through an eye portion 97 of the rod 92 and lodges itself in a narrower through hole in the adjustable heel by a press fit or friction fit (illustrated in FIG. 14).

FIG. 14, taken in FIG. 13 at the line 14—14, is a cross-section of the rear adjustable interface and boot portion, showing the dovetail 100 and the eye portion 97 of the adjustment rod 92 secured to the adjustable heel 102 by the pin member 96.

There is provided means of locating the rear rest 8 longitudinally in a spaced position for the rear rest in FIGS. 12 and 13, consisting of the base housing 60 (see FIGS. 7 to 11), which is slidably restrained at the sides by its base skirt 104 within overlapping sides of a base track 105, and wherein the latter is constructed with a longitudinal center rail portion 106 which includes regularly spaced rectangular holes 107. As a matter of example, four are illustrated that serve to locate the base housing 60 by means of a leaf spring-type clip 108, having one end secured to the underside of the housing 60 above the center rail 106 while the other end of the clip 108 has a tooth portion 109 which fits into the holes 107 (it should be added here again that the just described elements 104 to 109 all form part of the earlier-described holding means). Thus provision is made for the repositioning of the rear rest to fit boots of different sizes. More holes provide for additional sizes.

FIG. 15 is a cross-sectional side view of a boot plate 110, mentioned earlier, which, supported by the provided rear and front rests 8, 4, each having its respective base and bearing plates 14, 18, is provided with at least one connecting member 115 fastened at the one end to the boot plate 110 and at the other end to the bearing plate 18. It should be understood that the slot 28, cooperating with the screw 12 (see FIG. 3) can be made part of this embodiment also not so illustrated for the sake of clarity.

The ends of the connecting members 115 are of a greater thickness than that of the remainder thereof. It passes through a boot plate opening 116 at one end of the plate 110, while the other ends of the members 115 pass through a bearing plate opening 117 (another variant of the described, supporting means of this invention) held fast by being secured through openings in a buckle stop member 118. The latter is too large to pass back through the opening 117, thereby securing the connecting member or members 115 to the ski. Also, the ends of the members 115 that are secured to the boot plate 110 are of extra thickness, in the form of an end stop 119, to prevent it from passing through the opening 116.

Therefore when release occurs, the front and rear connecting members serve to prevent the ski from running away, and the presence of two connecting members 115, front and rear, also prevents windmilling of the ski about the skier's leg by the fact that the two connecting members, if so provided, oppose one another during a release rotation of the ski after a limited amount of travel of the skier off the ski. The travel is limited by the length of the connecting members.

It will be understood that the present invention covers various aspects of the described boot - ski interface mechanisms, both as actually shown and as combinations thereof. Various modifications, additions and changes can be made in the described and shown and the explained but not illustrated exemplary embodiments without departing from the spirit and scope of the invention.

What I claim is:

1. An improved adjustable boot - ski interface mechanism for elevationally adjusting interface conditions between a skier's boot (2) and a ski (1) for front and rear pivot conditions, a couple being formed between the interface mechanism and a releasable binding (82) that is fixed to the ski; the interface mechanism comprising at least one front rest mechanism (4) fixed to the ski for cooperation with at least one of front (6) and rear interface portions (10) of the boot; the binding serving to exert a predetermined retaining force before releasing the boot from the ski, upon occurrence of an external separating force, when the skier encounters an obstacle which results in the latter force; said interface mechanism comprising means in the form of a bearing member (18, 19) for supporting the boot in a spaced-apart relation with respect to the ski; means in the form of a base portion (14, 28) that is slidable with respect to said bearing member in a plane parallel to the upper surface of the ski and can be selectively secured to the ski, for holding said supporting means spaced with respect to the ski; means in the form of an inclined portion (16) that constitutes the upper surface of said base portion, at least partly intermediate said supporting and said holding means, for the elevational adjustment of said supporting means between the boot, on the one hand, and the ski as well as the binding thereon, on the other; and means in the form of at least one immobilizing screw element (12) for securing said base portion in a fixed position to the ski said bearing member having an aperture for receiving said screw, said screw passing through said aperture into the ski and preventing longitudinal movement of said bearing member, said base member having at least one longitudinal slot, said screw also passing through said slot and allowing selective longitudinal movement of said base member relative to said bearing member.

2. An improved adjustable boot - ski interface mechanism for elevationally adjusting interface conditions between a skier's boot (2) and a ski (1) for front and rear pivot conditions, a couple being formed between the interface mechanism and a releasable binding (82) that is fixed to the ski; the interface mechanism comprising at least one rear rest mechanism (8) fixed to the ski for cooperation with at least one of front (6) and rear interface portions (10) of the boot; the binding serving to exert a predetermined retaining force before releasing the boot from the ski, upon occurrence of an external separating force, when the skier encounters an obstacle which results in the latter force; said interface mechanism comprising means in the form of at least one bearing member (64) for supporting the boot in a spaced-apart relation with respect to the ski; means in the form of a base housing (60) secured to the ski for holding said supporting means against longitudinal movement with respect to the ski; said bearing member being adjustable in height with respect to said base housing; means (62, 65, 73, 75, 76), at least partly intermediate said supporting and said holding means, for the elevational adjustment of said supporting means between the boot, on the other hand, and the ski as well as the binding thereon, on the other; the height adjustment of said bearing member being by way of said adjusting means; and means (12) for securing said base housing in a fixed position to the ski; wherein the binding includes an operative portion (80) extending longitudinal of the ski on at least one side, above and within the side profile of the ski and movable outward of the ski; and said bearing member has on its top at least one laterally extending flange portion (72) such that said top of the bearing member generally spans the width of the ski, and wherein said base housing is more narrow than the ski width and generally centrally located thereon to provide side clearances for said operative portion of the binding.

* * * * *

UNITED STATES PATENT AND TRADEMARK OFFICE

CERTIFICATE OF CORRECTION

PATENT NO. : 4,135,736

DATED : January 23, 1979

INVENTOR(S) : Barry L. Druss

It is certified that error appears in the above—identified patent and that said Letters Patent is hereby corrected as shown below:

Column 2, line 5, before "e.g." insert a comma (,);

Column 5, line 67, after "of the" insert -- securing or --;

Column 10, line 5, change "other" to -- one --;

Column 10, line 11, change "longitudinal" to -- longitudinally --.

Signed and Sealed this

*Eighteenth* Day of *March 1980*

[SEAL]

*Attest:*

SIDNEY A. DIAMOND

*Attesting Officer*

*Commissioner of Patents and Trademarks*